US011473862B2

(12) United States Patent
Oh

(10) Patent No.: US 11,473,862 B2
(45) Date of Patent: Oct. 18, 2022

(54) FIREARM MAGAZINE FUNNEL AND SECURING MECHANISM THEREOF

(71) Applicant: Strike Industries, Inc., Santa Ana, CA (US)

(72) Inventor: Alvin Nam Oh, Santa Ana, CA (US)

( * ) Notice: Subject to any disclaimer, the term of this patent is extended or adjusted under 35 U.S.C. 154(b) by 97 days.

(21) Appl. No.: 17/026,240

(22) Filed: Sep. 20, 2020

(65) Prior Publication Data

US 2021/0088296 A1 Mar. 25, 2021

Related U.S. Application Data

(60) Provisional application No. 62/903,812, filed on Sep. 21, 2019.

(51) Int. Cl.
*F41A 3/66* (2006.01)
*F41A 9/65* (2006.01)

(52) U.S. Cl.
CPC . *F41A 3/66* (2013.01); *F41A 9/65* (2013.01)

(58) Field of Classification Search
CPC ..... F41A 3/66; F41A 9/65; F41C 3/00; F41C 23/16; F41C 23/12
See application file for complete search history.

(56) References Cited

U.S. PATENT DOCUMENTS 4,271,623 A * 6/1981 Beretta ..... F41C 23/04 42/72
4,520,585 A * 6/1985 Barrett ..... F41C 23/10 42/7
4,570,370 A * 2/1986 Smith ..... F41C 23/10 42/71.02
5,052,140 A * 10/1991 Smith ..... F41C 23/10 42/7
5,621,995 A * 4/1997 Smith ..... F41A 9/65 89/33.1
5,761,842 A * 6/1998 Mantymaa ..... F41C 23/12 42/72
5,778,588 A * 7/1998 Allen, III ..... F41C 23/12 42/72
6,854,205 B2 * 2/2005 Wikle ..... F41C 23/16 42/71.01
7,743,542 B1 * 6/2010 Novak ..... F41A 9/24 42/49.02
8,677,669 B1 * 3/2014 Vesligaj ..... F41C 23/04 42/75.01
8,910,407 B2 * 12/2014 Singh ..... F41C 23/06 89/37.04
9,921,029 B2 * 3/2018 Roberts ..... F41C 27/00
9,927,193 B2 * 3/2018 Beasley ..... F41A 9/71
(Continued)

*Primary Examiner* — Joshua T Semick
(74) *Attorney, Agent, or Firm* — Han IP PLLC; Andy M. Han

(57) ABSTRACT

A device implementable on a firearm includes a magazine funnel and a securing mechanism. The magazine funnel is configured to couple to an opening at a bottom of a grip of the firearm. The magazine funnel has a first side and a second side opposite the first side. The securing mechanism protrudes from the first side of the magazine funnel such that, when a gap related to the securing mechanism is expanded while the magazine funnel is coupled to the opening with the securing mechanism inserted into a void of the grip, the securing mechanism secures the magazine funnel to the grip of the firearm.

17 Claims, 4 Drawing Sheets

*Continue to screw in screw 4 until gap between first tab 2 and second tab 3 is sufficiently expanded to firmly hold magazine funnel 1 in place*

(56) References Cited

U.S. PATENT DOCUMENTS

| | | | | |
|---|---|---|---|---|
| 10,066,885 | B2 * | 9/2018 | Chen | F41A 9/65 |
| 10,488,142 | B2 * | 11/2019 | Jacobson | F41A 23/18 |
| 10,830,557 | B2 * | 11/2020 | Faifer | F41C 23/04 |
| 10,845,138 | B2 * | 11/2020 | Landis | F41A 17/38 |
| 2019/0226779 | A1 * | 7/2019 | DiChario | F41A 9/71 |

* cited by examiner

*Insert screw 4*

*Continue to screw in screw 4 until gap between first tab 2 and second tab 3 is sufficiently expanded to firmly hold magazine funnel 1 in place*

FIREARM MAGAZINE FUNNEL AND SECURING MECHANISM THEREOF

CROSS REFERENCE TO RELATED PATENT APPLICATION(S)

The present disclosure is part of a non-provisional patent application claiming the priority benefit of U.S. Provisional Patent Application No. 62/903,812, filed 21 Sep. 2019, the content of which being incorporated by reference in its entirety.

TECHNICAL FIELD

The present disclosure is generally related to firearms and, more particularly, to a firearm magazine funnel and a securing mechanism thereof.

BACKGROUND

Unless otherwise indicated herein, approaches described in this section are not prior art to the claims listed below and are not admitted as prior art by inclusion in this section.

In the context of firearms, a detachable magazine is an ammunition storage and feeding mechanism or device that can be attached to a firearm. In operation, when the magazine is loaded with ammunition cartridges and attached to the firearm, an internal spring of the magazine exerts a force on a spring follower, which in turn pushes one or more rounds of the ammunition cartridges in the magazine well toward an action chamber of the firearm, thereby assisting in loading the rounds into the action chamber of the firearm.

On various pistols, a magazine is inserted into a grip of the pistol to be attached to the pistol. That is, the grip of the pistol is hollow with a void therein and with an opening toward the bottom side of the pistol, and the magazine is inserted into the void through the opening. To aid speedy insertion of the magazine into the grip, a magazine funnel may be installed at the opening to help guide the magazine.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In one aspect, a device implementable on a firearm (e.g., a pistol such as a semi-automatic pistol) may include a magazine funnel and a securing mechanism. The magazine funnel may be configured to couple to an opening at a bottom of a grip of the firearm. The magazine funnel may have a first side and a second side opposite the first side. The securing mechanism may protrude from the first side of the magazine funnel such that, when a gap related to the securing mechanism is expanded while the magazine funnel is coupled to the opening with the securing mechanism inserted into a void of the grip, the securing mechanism may secure the magazine funnel to the grip of the firearm.

In another aspect, a device implementable on a firearm (e.g., a pistol such as a semi-automatic pistol) may include a magazine funnel and a securing mechanism. The magazine funnel may be configured to couple to an opening at a bottom of a grip of the firearm. The magazine funnel may have a first side and a second side opposite the first side. The securing mechanism may protrude from the first side of the magazine funnel such that, when one or more components of the securing mechanism are bent while the magazine funnel is coupled to the opening with the securing mechanism inserted into a void of the grip, the securing mechanism may secure the magazine funnel to the grip of the firearm.

In one aspect, an apparatus implementable on a firearm (e.g., a pistol such as a semi-automatic pistol) may include a pistol frame of the firearm having a grip and a device. The device may include a magazine funnel and a securing mechanism. The magazine funnel may be configured to couple to an opening at a bottom of the grip. The magazine funnel may have a first side and a second side opposite the first side. The securing mechanism may protrude from the first side of the magazine funnel such that, when a gap related to the securing mechanism is expanded while the magazine funnel is coupled to the opening with the securing mechanism inserted into a void of the grip, the securing mechanism may secure the magazine funnel to the grip.

It is noteworthy that, although description provided herein may be in the context of certain configurations such as a magazine used in pistols, the proposed concepts, schemes and any variation(s)/derivative(s) thereof may be implemented in, for and by other configurations and designs, such as magazines used in rifles, carbines and shotguns. Thus, the scope of the present disclosure is not limited to the examples described herein.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Figure 1:
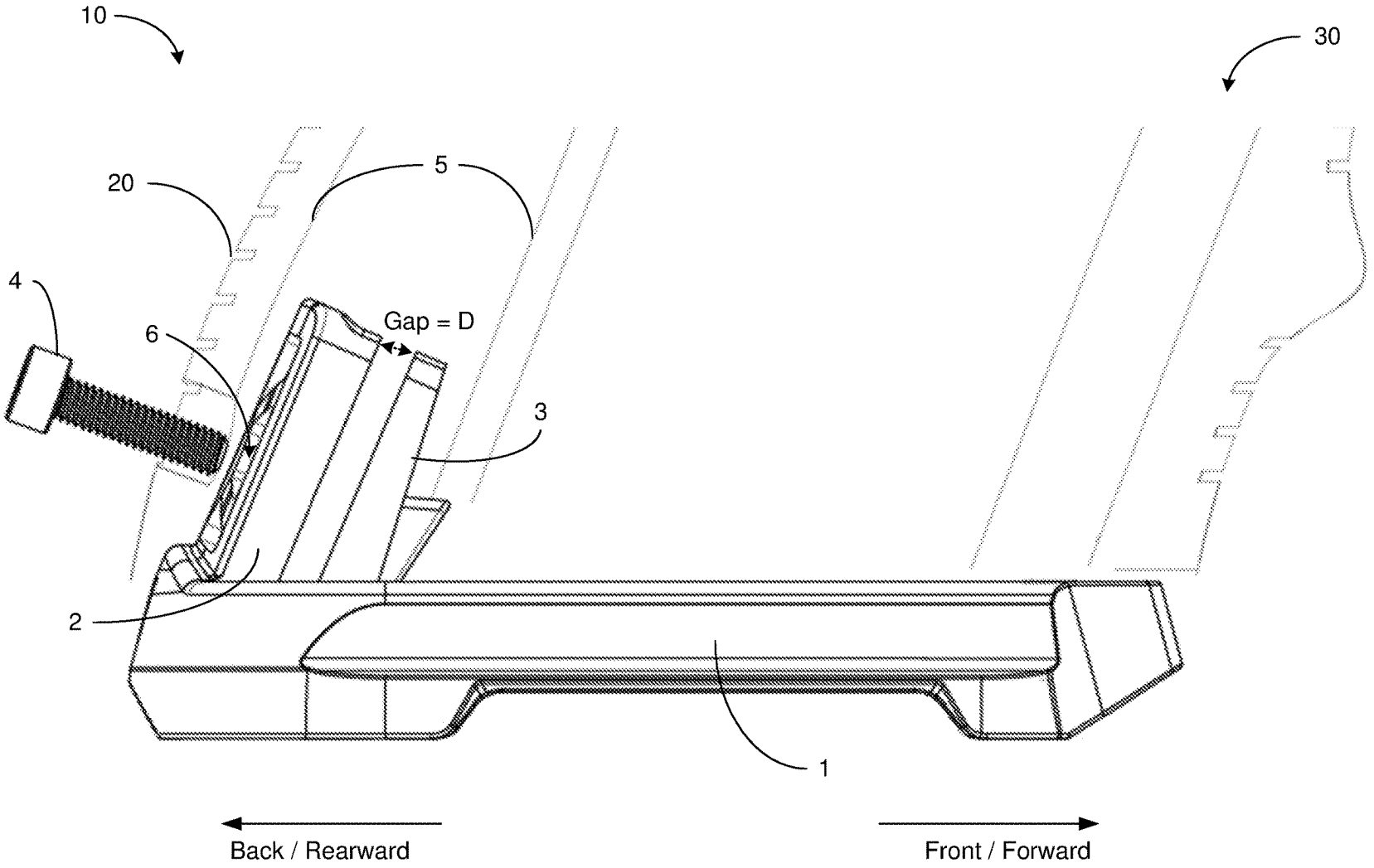
FIG. 1 is a diagram of a first step in assembling components of a firearm magazine funnel and securing mechanism in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Figure 2:
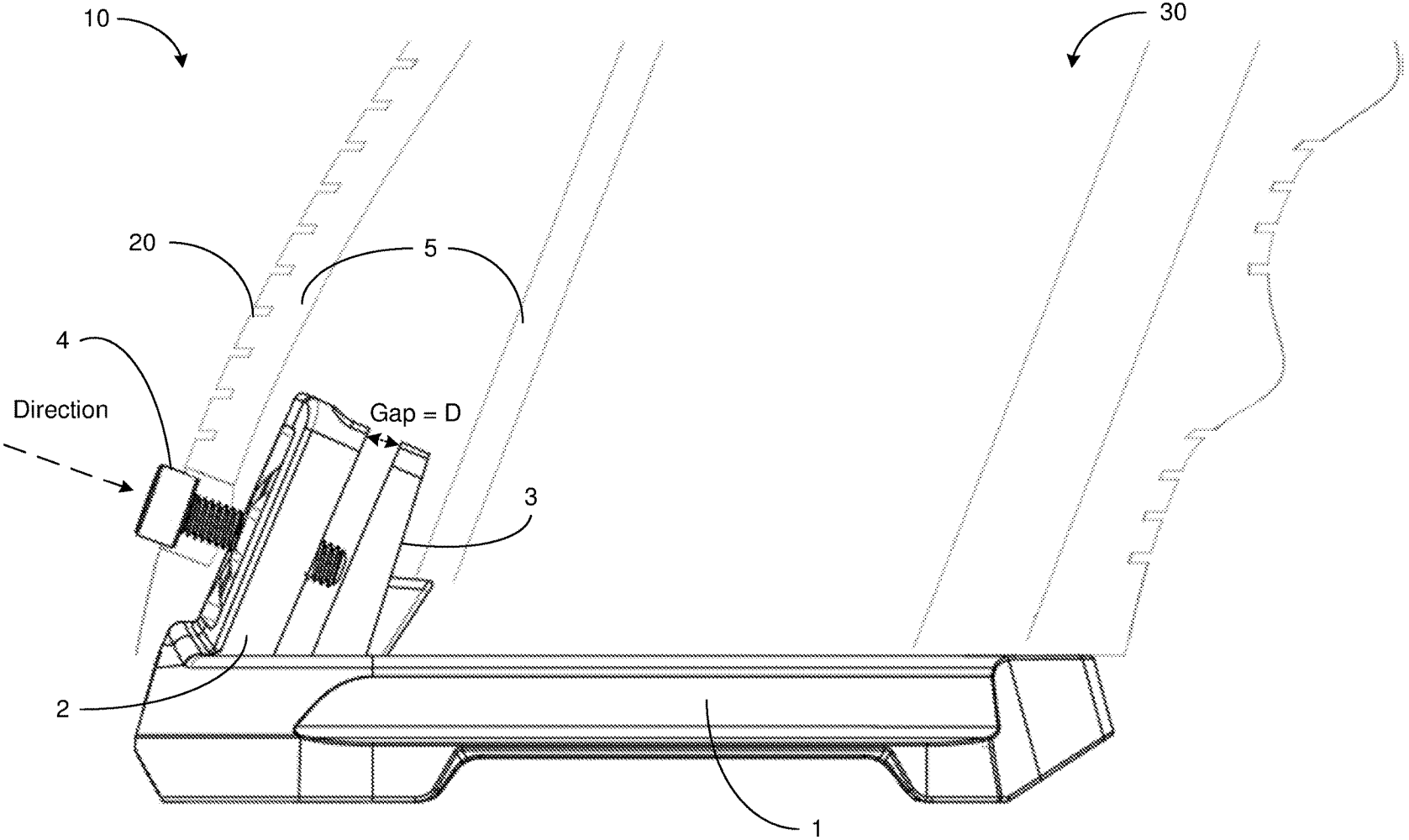
FIG. 2 is a diagram of a second step in assembling components of a firearm magazine funnel and securing mechanism in accordance with an implementation of the present disclosure.
Figure 3:
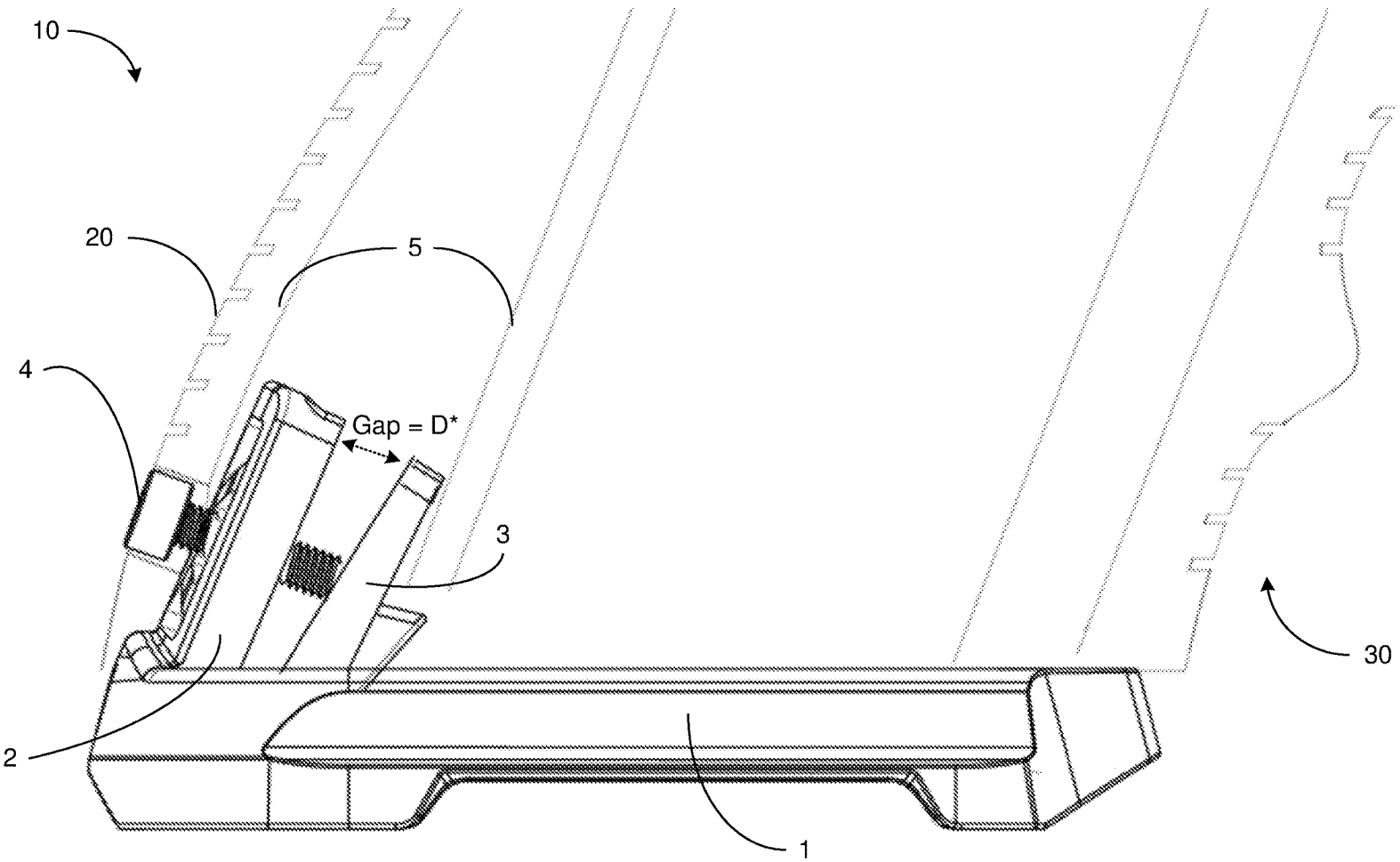
FIG. 3 is a diagram of a third step in assembling components of a firearm magazine funnel and securing mechanism in accordance with an implementation of the present disclosure.

FIG. 1~FIG. 3 illustrate sequential steps in assembling components of a device 10 in accordance with an implementation of the present disclosure. Referring to FIG. 1~FIG. 3, device 10 in accordance with the present disclosure may include a magazine funnel 1 and a securing mechanism comprising a first tab 2 and a second tab 3. Device 10 may be implementable on a firearm such as, for example and without limitation, a semi-automatic or a full-automatic pistol.

Under a proposed scheme in accordance with the present disclosure, magazine funnel 1 may be configured to couple to an opening at a bottom of a grip 20 of a pistol frame 30 of the firearm. Magazine funnel 1 may have a first side (e.g., top side shown in FIG. 1~FIG. 3) and a second side (e.g., bottom side shown in FIG. 1~FIG. 3) opposite the first side. Securing mechanism may protrude from the first side of magazine funnel 1 such that, when a gap D related to the securing mechanism is expanded while magazine funnel 1 is coupled to the opening with the securing mechanism inserted into a void of grip 20, the securing mechanism may secure magazine funnel 1 to grip 20.

Under a proposed scheme in accordance with the present disclosure, first tab 2 may protrude from the first side of magazine funnel 1 and may be configured with a threaded hole 6. Second tab 3 may protrude from the first side of magazine funnel 1 and may be parallel to first tab 2 with gap D between first tab 2 and second tab 3. In such cases, when the securing mechanism is inserted into the void of grip 20 when magazine funnel 1 is coupled to the opening at the bottom of grip 20, first tab 2 may be between second tab 3 and a back wall of grip 20. Under the proposed scheme, device 10 may further include a screw 4. When screw 4 is screwed through the back wall of grip 20 and threaded hole 6 of first tab 2, screw 4 may push against second tab 3 such that, as screw 4 is further screwed in or otherwise further inserted into the void of grip 20, first tab 2 is pulled toward the back wall of grip 20 while second tab 3 is pushed away from the back wall of grip 20 to result in the gap D being expanded to become D*(D*>D). Thus, as first tab 2 is pulled toward the back wall of grip 20 while second tab 3 is pushed away from the back wall of grip 20, at least one of first tab 2 and second tab 3 may come in contact with a physical portion of an internal structure 5 of grip 20.

Under a proposed scheme in accordance with the present disclosure, magazine funnel 1 and the securing mechanism (e.g., first tab 2 and second tab 3) may be portions of a monolithic piece. For instance, the monolithic piece may be made of polymer or plastic. Alternatively, the monolithic piece may be made of metal or alloy. Still alternatively, magazine funnel 1 and the securing mechanism may be made of different materials. For instance, magazine funnel 1 may be made of metal or alloy, and the securing mechanism (e.g., first tab 2 and second tab 3) may be made of polymer or plastic.

Under a proposed scheme in accordance with the present disclosure, magazine funnel 1 may be configured to couple to an opening at a bottom of a grip 20 of a pistol frame 30 of the firearm. Magazine funnel 1 may have a first side (e.g., top side shown in FIG. 1~FIG. 3) and a second side (e.g., bottom side shown in FIG. 1~FIG. 3) opposite the first side. Securing mechanism may protrude from the first side of magazine funnel 1 such that, when one or more components of the securing mechanism (e.g., first tab 2 and/or second tab 3) is/are bent while magazine funnel 1 is coupled to the opening with the securing mechanism inserted into a void of grip 20, the securing mechanism may secure magazine funnel 1 to grip 20. Under the proposed scheme, as screw 4 is further screwed in or otherwise further inserted into the void of grip 20, first tab 2 may be pulled toward the back wall of grip 20 while second tab 3 may be pushed away from the back wall of grip 20 to result in at least one of first tab 2 and second tab 3 being bent, as shown in FIG. 3.

Figure 4:
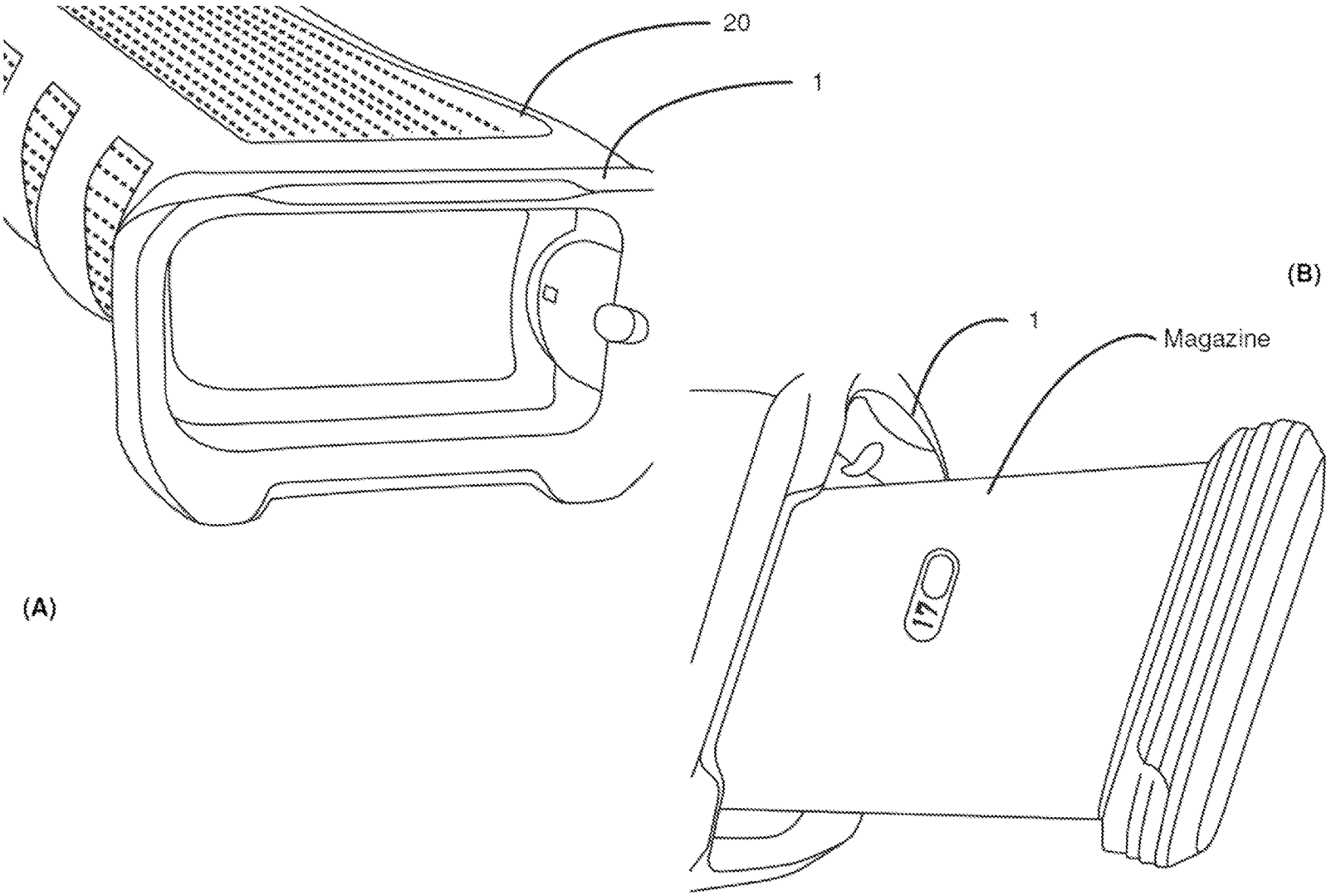
FIG. 4 is a diagram of example implementations of a firearm magazine funnel and securing mechanism in accordance with the present disclosure.

FIG. 4 illustrates example implementations of a firearm magazine funnel 1 and securing mechanism in accordance with the present disclosure. Part (A) of FIG. 4 shows a real-life example of a magazine funnel 1 being coupled to or otherwise mounted on a grip 20 of a firearm (e.g., pistol) while magazine funnel 1 is secured to grip 20. Part (B) of FIG. 4 shows a real-life example of a magazine of the firearm being inserted into a void or tunnel of grip 20 of the firearm through magazine funnel 1 while magazine funnel 1 is secured to grip 20.

Highlight of Features

In view of the above description and FIG. 1~FIG. 4, certain features of a firearm magazine extension are highlighted below.

In one aspect, a device implementable on a firearm (e.g., a pistol such as a semi-automatic pistol) may include a magazine funnel and a securing mechanism. The magazine funnel may be configured to couple to an opening at a bottom of a grip of the firearm. The magazine funnel may have a first side and a second side opposite the first side. The securing mechanism may protrude from the first side of the magazine funnel such that, when a gap related to the securing mechanism is expanded while the magazine funnel is coupled to the opening with the securing mechanism inserted into a void of the grip, the securing mechanism may secure the magazine funnel to the grip of the firearm.

In some implementations, the securing mechanism may include a first tab and a second tab. The first tab may protrude from the first side of the magazine funnel and may be configured with a threaded hole. The second tab may protrude from the first side of the magazine funnel and may be parallel to the first tab. In such cases, when the securing mechanism is inserted into the void of the grip when the magazine funnel is coupled to the opening at the bottom of the grip, the first tab may be between the second tab and a back wall of the grip. Moreover, the gap may be a gap between the first tab and the second tab.

In some implementations, the device may further include a screw. In such cases, when the screw is screwed through the back wall of the grip and the threaded hole of the first tab, the screw may push against the second tab such that, as the screw is further screwed in, the first tab may be pulled toward the back wall of the grip while the second tab may be pushed away from the back wall of the grip to result in the gap being expanded.

In some implementations, as the first tab is pulled toward the back wall of the grip while the second tab is pushed away from the back wall of the grip, at least one of the first tab and the second tab may come in contact with a physical portion of an internal structure of the grip.

In some implementations, the magazine funnel and the securing mechanism may be portions of a monolithic piece. In some implementations, the monolithic piece may be made of polymer or plastic. Alternatively, the magazine funnel may be made of metal or alloy.

In another aspect, a device implementable on a firearm (e.g., a pistol such as a semi-automatic pistol) may include a magazine funnel and a securing mechanism. The magazine funnel may be configured to couple to an opening at a bottom of a grip of the firearm. The magazine funnel may have a first side and a second side opposite the first side. The securing mechanism may protrude from the first side of the magazine funnel such that, when one or more components of the securing mechanism are bent while the magazine funnel is coupled to the opening with the securing mechanism inserted into a void of the grip, the securing mechanism may secure the magazine funnel to the grip of the firearm.

In some implementations, the securing mechanism may include a first tab and a second tab. The first tab may protrude from the first side of the magazine funnel and may be configured with a threaded hole. The second tab may protrude from the first side of the magazine funnel and may be parallel to the first tab. In such cases, when the securing mechanism is inserted into the void of the grip when the magazine funnel is coupled to the opening at the bottom of the grip, the first tab may be between the second tab and a back wall of the grip.

In some implementations, the device may further include a screw. In such cases, when the screw is screwed through the back wall of the grip and the threaded hole of the first tab, the screw pushes against the second tab such that, as the screw is further screwed in, the first tab may be pulled toward the back wall of the grip while the second tab may be pushed away from the back wall of the grip to result in at least one of the first tab and the second tab being bent.

In some implementations, as the first tab is pulled toward the back wall of the grip while the second tab is pushed away from the back wall of the grip, at least one of the first tab and the second tab may come in contact with a physical portion of an internal structure of the grip.

In some implementations, the magazine funnel and the securing mechanism may be portions of a monolithic piece. In some implementations, the monolithic piece may be made of polymer or plastic. Alternatively, the magazine funnel may be made of metal or alloy.

In one aspect, an apparatus implementable on a firearm (e.g., a pistol such as a semi-automatic pistol) may include a pistol frame of the firearm having a grip and a device. The device may include a magazine funnel and a securing mechanism. The magazine funnel may be configured to couple to an opening at a bottom of the grip. The magazine funnel may have a first side and a second side opposite the first side. The securing mechanism may protrude from the first side of the magazine funnel such that, when a gap related to the securing mechanism is expanded while the magazine funnel is coupled to the opening with the securing mechanism inserted into a void of the grip, the securing mechanism may secure the magazine funnel to the grip.

In some implementations, the securing mechanism may include a first tab and a second tab. The first tab may protrude from the first side of the magazine funnel and may be configured with a threaded hole. The second tab may protrude from the first side of the magazine funnel and may be parallel to the first tab. In such cases, when the securing mechanism is inserted into the void of the grip when the magazine funnel is coupled to the opening at the bottom of the grip, the first tab may be between the second tab and a back wall of the grip. Moreover, the gap may be a gap between the first tab and the second tab.

In some implementations, the device may further include a screw. In such cases, when the screw is screwed through the back wall of the grip and the threaded hole of the first tab, the screw may push against the second tab such that, as the screw is further screwed in, the first tab may be pulled toward the back wall of the grip while the second tab may be pushed away from the back wall of the grip to result in the gap being expanded.

In some implementations, as the first tab is pulled toward the back wall of the grip while the second tab is pushed away from the back wall of the grip, at least one of the first tab and the second tab may come in contact with a physical portion of an internal structure of the grip.

In some implementations, the magazine funnel and the securing mechanism may be portions of a monolithic piece. In some implementations, the monolithic piece may be made of polymer or plastic. Alternatively, the magazine funnel may be made of metal or alloy.

ADDITIONAL NOTES

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a magazine funnel configured to couple to an opening at a bottom of a grip of the firearm, the magazine funnel having a first side and a second side opposite the first side;

a securing mechanism protruding from the first side of the magazine funnel such that, when a gap related to the securing mechanism is expanded while the magazine funnel is coupled to the opening with the securing mechanism inserted into a void of the grip, the securing mechanism secures the magazine funnel to the grip of the firearm; and a screw, wherein the securing mechanism comprises:

a first tab protruding from the first side of the magazine funnel and comprising a threaded hole; and a second tab protruding from the first side of the magazine funnel and parallel to the first tab, wherein the gap comprises a gap between the first tab and the second tab, and wherein, when the screw is screwed through the back wall of the grip and the threaded hole of the first tab, the screw pushes against the second tab such that, as the screw is further screwed in, the first tab is pulled toward the back wall of the grip while the second tab is pushed away from the back wall of the grip to result in the gap being expanded.

2. The device of claim 1, wherein, when the securing mechanism is inserted into the void of the grip when the magazine funnel is coupled to the opening at the bottom of the grip, the first tab is between the second tab and a back wall of the grip.

3. The device of claim 1, wherein, as the first tab is pulled toward the back wall of the grip while the second tab is pushed away from the back wall of the grip, at least one of the first tab and the second tab comes in contact with a physical portion of an internal structure of the grip.

4. The device of claim 1, wherein the magazine funnel and the securing mechanism are portions of a monolithic piece.

5. The device of claim 4, wherein the monolithic piece is made of polymer or plastic.

6. The device of claim 1, wherein the magazine funnel is made of metal or alloy.

7. A device implementable on a firearm, comprising:

a magazine funnel configured to couple to an opening at a bottom of a grip of the firearm, the magazine funnel having a first side and a second side opposite the first side;

a securing mechanism protruding from the first side of the magazine funnel such that, when one or more components of the securing mechanism are bent while the magazine funnel is coupled to the opening with the securing mechanism inserted into a void of the grip, the securing mechanism secures the magazine funnel to the grip of the firearm; and a screw, wherein the securing mechanism comprises:

a first tab protruding from the first side of the magazine funnel and comprising a threaded hole; and a second tab protruding from the first side of the magazine funnel and parallel to the first tab, wherein, when the screw is screwed through the back wall of the grip and the threaded hole of the first tab, the screw pushes against the second tab such that, as the screw is further screwed in, the first tab is pulled toward the back wall of the grip while the second tab is pushed away from the back wall of the grip to result in at least one of the first tab and the second tab being bent.

8. The device of claim 7, wherein, when the securing mechanism is inserted into the void of the grip when the magazine funnel is coupled to the opening at the bottom of the grip, the first tab is between the second tab and a back wall of the grip.

9. The device of claim 7, wherein, as the first tab is pulled toward the back wall of the grip while the second tab is pushed away from the back wall of the grip, at least one of the first tab and the second tab comes in contact with a physical portion of an internal structure of the grip.

10. The device of claim 7, wherein the magazine funnel and the securing mechanism are portions of a monolithic piece.

11. The device of claim 10, wherein the monolithic piece is made of polymer or plastic.

12. The device of claim 7, wherein the magazine funnel is made of metal or alloy.

13. An apparatus implementable on a firearm, comprising:

a pistol frame of the firearm having a grip; and a device comprising:

a magazine funnel configured to couple to an opening at a bottom of the grip, the magazine funnel having a first side and a second side opposite the first side;

a securing mechanism protruding from the first side of the magazine funnel such that, when a gap related to the securing mechanism is expanded while the magazine funnel is coupled to the opening with the securing mechanism inserted into a void of the grip, the securing mechanism secures the magazine funnel to the grip; and a screw, wherein the securing mechanism comprises:

a first tab protruding from the first side of the magazine funnel and comprising a threaded hole; and a second tab protruding from the first side of the magazine funnel and parallel to the first tab, wherein the gap comprises a gap between the first tab and the second tab, and wherein, when the screw is screwed through the back wall of the grip and the threaded hole of the first tab, the screw pushes against the second tab such that, as the screw is further screwed in, the first tab is pulled toward the back wall of the grip while the second tab is pushed away from the back wall of the grip to result in the gap being expanded.

14. The apparatus of claim 13, wherein, when the securing mechanism is inserted into the void of the grip when the magazine funnel is coupled to the opening at the bottom of the grip, the first tab is between the second tab and a back wall of the grip.

15. The apparatus of claim 13, wherein, as the first tab is pulled toward the back wall of the grip while the second tab is pushed away from the back wall of the grip, at least one of the first tab and the second tab comes in contact with a physical portion of an internal structure of the grip.

16. The apparatus of claim 13, wherein the magazine funnel and the securing mechanism are portions of a monolithic piece.

17. The apparatus of claim 16, wherein the monolithic piece is made of polymer or plastic.

* * * * *